US010117036B2

(12) United States Patent
Wen et al.

(10) Patent No.: US 10,117,036 B2
(45) Date of Patent: Oct. 30, 2018

(54) CALIBRATION METHOD AND CALIBRATION MODULE THEREOF FOR VIBRATION DEVICE

(71) Applicant: MEDIATEK INC., Hsin-Chu (TW)

(72) Inventors: Sung-Han Wen, Taipei (TW); Chun-Yuan Cheng, Taipei (TW); Chin-Yuan Chang, Hsinchu (TW)

(73) Assignee: MediaTek Inc., Hsin-Chu (TW)

( * ) Notice: Subject to any disclaimer, the term of this patent is extended or adjusted under 35 U.S.C. 154(b) by 84 days.

(21) Appl. No.: 14/179,525

(22) Filed: Feb. 12, 2014

(65) Prior Publication Data

US 2014/0161266 A1 Jun. 12, 2014

Related U.S. Application Data

(63) Continuation-in-part of application No. 13/334,059, filed on Dec. 22, 2011, now Pat. No. 9,124,961.

(60) Provisional application No. 61/767,287, filed on Feb. 21, 2013, provisional application No. 61/508,507, filed on Jul. 15, 2011.

(51) Int. Cl.
*H04R 29/00* (2006.01)

(52) U.S. Cl.
CPC ..... *H04R 29/001* (2013.01); *H04R 2400/03* (2013.01)

(58) Field of Classification Search
CPC ... B06B 1/0238; B06B 1/0269; B06B 1/0284; B06B 1/0207; B06B 1/0246; B06B 1/0253; B06B 1/0261; B06B 1/161; H04R 29/001; H04R 2400/03; H04S 7/307; H03G 5/00; H03G 5/005; H03G 5/16; H03G 5/24; H04M 19/047; G01H 13/00

See application file for complete search history.

(56) References Cited

U.S. PATENT DOCUMENTS 4,275,388 A * 6/1981 Hornung ..... B06B 1/0261 331/116 R
4,641,361 A 2/1987 Rosback
8,156,809 B2 4/2012 Tierling
8,773,257 B2 * 7/2014 Yodfat ..... A61M 5/14248 340/384.6
2005/0047621 A1 3/2005 Cranfill
(Continued)

FOREIGN PATENT DOCUMENTS

CN 101594565 A 12/2009
CN 101754083 A 6/2010
(Continued)

OTHER PUBLICATIONS

English machine translation of DE 4001367 A1 (Altena et al., Device for adjusting a machine parameter in friction welding, published Sep. 1991).*

*Primary Examiner* — Mark Fischer
(74) *Attorney, Agent, or Firm* — Wolf, Greenfield & Sacks, P.C.

(57) ABSTRACT

A calibration method for a vibration module includes transmitting a plurality of vibration signals corresponding to a plurality of vibration frequencies to the vibration module and detecting a plurality of input currents or input power levels of the vibration module corresponding to the plurality of vibration frequencies; and determining a vibration point of the vibration module according to the plurality of input currents or input power levels.

19 Claims, 12 Drawing Sheets

(56) References Cited

U.S. PATENT DOCUMENTS

| | | | | |
|---|---|---|---|---|
| 2008/0240484 | A1 | 10/2008 | Tanghe | |
| 2009/0243997 | A1* | 10/2009 | Tierling | G06F 3/016 345/156 |
| 2010/0061569 | A1 | 3/2010 | Kamatori | |
| 2011/0018507 | A1* | 1/2011 | McCloy-Stevens | H02M 3/1588 323/271 |
| 2011/0181209 | A1* | 7/2011 | Murata | H02P 3/20 318/128 |
| 2011/0221583 | A1 | 9/2011 | Yodfat et al. | |
| 2012/0012240 | A1* | 1/2012 | Klinstein | B06B 1/0261 156/64 |
| 2012/0063632 | A1 | 3/2012 | Aoki | |
| 2013/0088297 | A1* | 4/2013 | Alexander | H03F 1/26 330/251 |

FOREIGN PATENT DOCUMENTS

| | | | | |
|---|---|---|---|---|
| CN | 101924972 | A | 12/2010 | |
| CN | 101982750 | A | 3/2011 | |
| CN | 102158169 | A | 8/2011 | |
| CN | 102336020 | A | 2/2012 | |
| DE | 4001367 | A1 * | 9/1991 | B06B 1/0261 |

* cited by examiner

CALIBRATION METHOD AND CALIBRATION MODULE THEREOF FOR VIBRATION DEVICE

CROSS REFERENCE TO RELATED APPLICATIONS

This application claims the benefit of U.S. Provisional Application No. 61/767,287 filed on 2013 Feb. 21, and is a continuing in part (CIP) application of U.S. application Ser. No. 13/334,059 which is filed on 2011 Dec. 22 and claims the benefit of U.S. Provisional Application No. 61/508,507 filed on 2011 Jul. 15, the contents of which are incorporated herein in their entirety.

BACKGROUND OF THE INVENTION

1. Field of the Invention

The disclosed embodiments of the present application relates to a calibration method and calibration module thereof for a vibration module, and more particularly, to a calibration method and calibration module thereof capable of detecting a vibration point of a vibration module.

A conventional multi-function speaker includes "2-in-1 Speaker" and "3-in-1 Speaker". The functions supported by the multi-function speaker may include audio playback, voice playback, and vibration, and thus, the multi-function speaker is also known as a vibration speaker. Due to its low cost and compact size, the vibration speaker is widely used in modern communications appliances.

As to the vibration function, the vibration speaker vibrates according to a vibration signal which may be a sinusoidal signal in a frequency band of 100 Hz-200 Hz. A level of the vibration speaker vibrating varies according to the frequency corresponding to the vibration signal. Please refer to FIG. 1, which is a vibration response chart of a vibration speaker, wherein the greater acceleration means the vibration speaker vibrates more heavily. As shown in FIG. 1, the vibration speaker vibrates most heavily at a frequency which is so called a vibration point. Generally, the vibration signal inputted to the vibration speaker would be the frequency corresponding to the vibration point, for achieving the maximum vibration level.

Due to different manufacturing methods and different structures of the vibration speaker, the vibration point of each vibration speaker would vary, however. Besides, the vibration point of the vibration speaker is further changed when the vibration speaker is configured to an electronic device. If the vibration point changes and the frequency corresponding to the vibration signal inputted to the vibration speaker does not accordingly vary, the vibration function of the vibration speaker may be disabled. Thus, how to acquire the vibration point corresponding to each vibration speaker becomes an important issue in the industry.

2. Description of the Prior Art

Therefore, one objective of the present application is to provide a calibration method and calibration module thereof capable of detecting a vibration point of a vibration module.

One embodiment of the present application discloses a calibration method for a vibration module. The calibration method comprises transmitting a plurality of vibration signals corresponding to a plurality of vibration frequencies to the vibration module; detecting a plurality of input currents or input power level of the vibration module corresponding to the plurality of vibration signals; and computing a vibration point of the vibration module according to the plurality of input currents or input power levels.

Another embodiment of present application further discloses a calibration module for a vibration module. The calibration module comprises a computing unit coupled to the vibration module, for transmitting a plurality of vibration signals corresponding to a plurality of vibration frequencies to the vibration module and computing a vibration point of the vibration module according to a plurality of input currents or input power levels of the vibration module corresponding to the plurality of vibration signals; and a sensing unit coupled to the vibration module, for detecting the plurality of input currents or input power levels.

In view of above-mentioned embodiments, the vibration point of the vibration module is determined according to the input currents or input power levels of the vibration module corresponding to different calibration frequencies. Therefore, the vibration function of the vibration module may be prevented from being disabled due to variations of the vibration point.

SUMMARY OF THE INVENTION

FIG. 1 is a vibration response chart of a vibration speaker.

FIG. 2 is a schematic diagram of a vibration device according to an embodiment of the present application.

FIG. 3A is a schematic diagram of a relationship between input currents and calibration frequencies.

FIG. 3B is a schematic diagram of a relationship between input power levels and calibration frequencies.

FIG. 4 is a simplified circuit diagram of the vibration module shown in FIG. 2.

FIG. 5A and FIG. 5B are schematic diagrams of the relation between the input current and the calibration frequencies.

FIGS. 6A-6D are schematic diagrams of realizations of the vibration device shown in FIG. 2.

FIG. 7 is a schematic diagram of a calibration method according to an embodiment of the present application.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

Detailed Description

Figure 1:
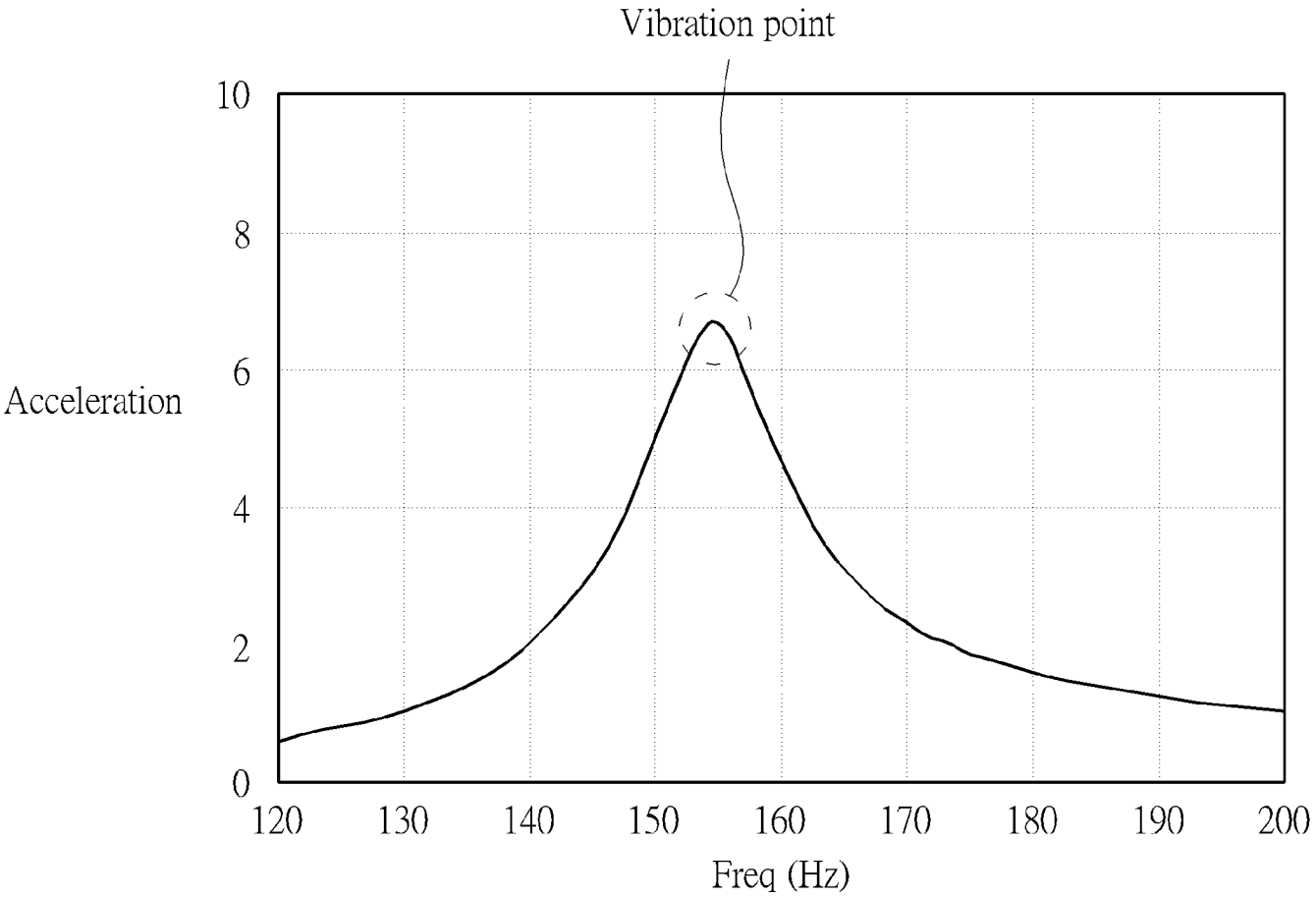
FIG. 1 PRIOR ART
Figure 2:
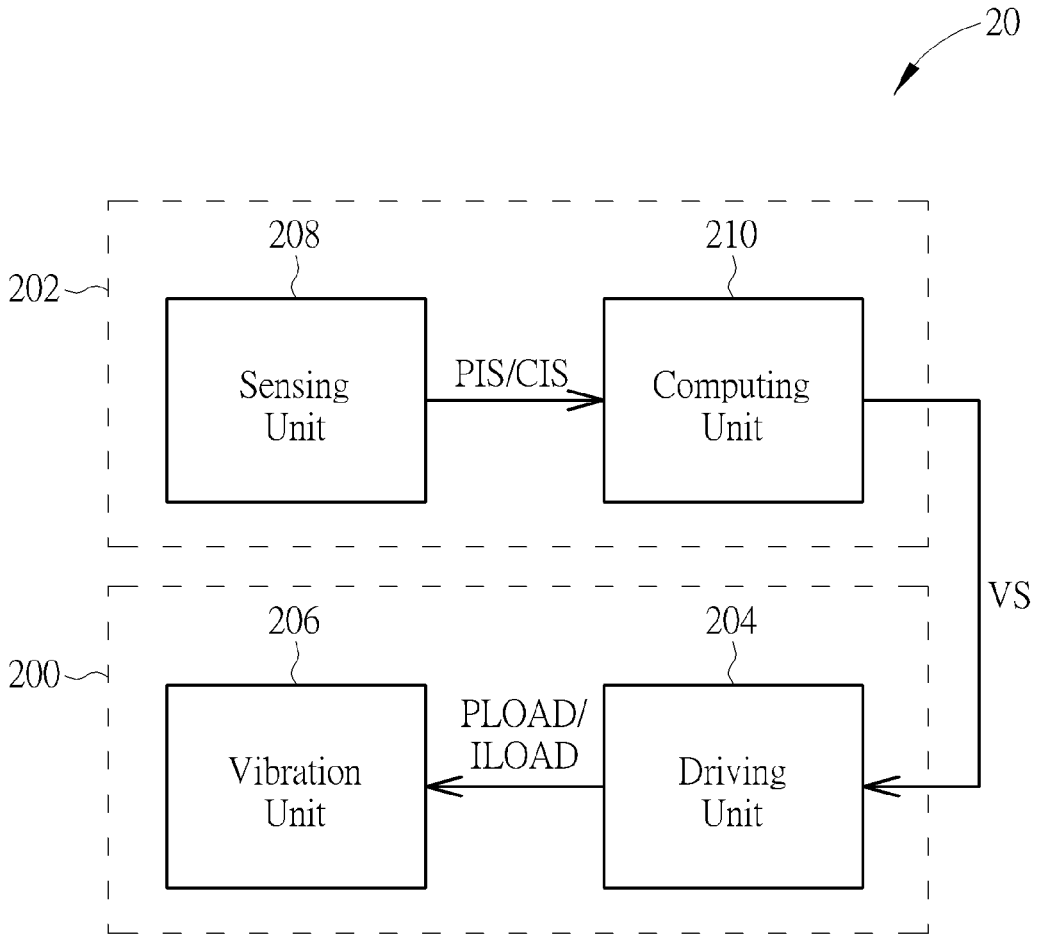

Please refer to FIG. 2, which is a schematic diagram of a vibration device 20 according to one embodiment of the present application. The vibration device 20 is a device capable of vibrating according to a vibration signal VS and determining a vibration point VP, but is not limited herein. For example, the functions supported by the vibration device 20 may further include audio playback and voice playback. As shown in FIG. 2, the vibration device 20 comprises a vibration module 200 and a calibration module 202. The vibration module 200 comprises a driving unit 204 and a vibration unit 206, for vibrating according to the vibration signal VS. The calibration module 202 comprises a sensing unit 208 and a computing unit 210, for adjusting a frequency of the vibration signal VS and detecting an input current ILOAD or an input power level PLOAD of the vibration module 200, so as to acquire the vibration point VP of the vibration module 200 according to the input current ILOAD or the input power level PLOAD corresponding to the vibration signal VS with different frequencies. As a result, even if the vibration point VP is changed due to different manufacturing methods, different structures of the vibration module 200 or process variations, or is varied after the vibration device 20 is configured in another device, the vibration point VP may be detected, precisely, and the frequency of the vibration signal VS may be accordingly set as the vibration point. The vibration function of the vibration device 20 may be prevented from being disabled or performance degradation due to variations of the vibration point VP.

In detail, the computing unit 210 (for example, a processor) first sets the frequency of the vibration signal VS to a calibration frequency FCAL_1 and transmits the vibration signal VS to the driving unit 204. At the same time, the driving unit 204 generates the input current ILOAD according to the vibration signal VS with the calibration frequency FCAL_1 to the vibration unit 206, for allowing the vibration unit 206 to vibrate according to the input current ILOAD. The vibration unit 206 may be a vibration speaker, but is not limited herein. The sensing unit 208 detects the current value of the input current ILOAD corresponding to the calibration frequency FCAL_1 as an input current ILOAD_1 and informs the computing unit 210 of the input current ILOAD_1 via a current indicating signal CIS. In another embodiment, the sensing unit 208 detects the power value of the vibration module 200 (or vibration unit 206) corresponding to the calibration frequency FCAL_1 as an input power level PLOAD_1 and informs the computing unit 210 of the input power level PLOAD_1 via a power indicating signal PIS. Similarly, the computing unit 210 then sets the frequency of the vibration signal VS to a calibration frequency FCAL_2 and transmits the vibration signal VS to the driving unit 204. The driving unit 204 generates the input current ILOAD according to the vibration signal VS with the calibration frequency FCAL_2 to the vibration unit 206, for allowing the vibration unit 206 to vibrate according to the input current ILOAD or the input power level PLOAD. The sensing unit 208 detects the current value of the input current ILOAD corresponding to the calibration frequency FCAL_2 as an input current ILOAD_2 or an input power level PLOAD_2 and informs the computing unit 210 of the input current ILOAD_2 via the current indicating signal CIS or the power indicating signal PIS, and so on. Note that the sensing unit 208 may include an analog-to-digital converter (ADC) to convert the sensed information from analog domain to digital domain for processing in the computing unit 210. After the computing unit 210 adjusts the frequency of the vibration signal VS to the calibration frequencies FCAL_1-FCAL_n sequentially, the computing unit 210 acquires a relationship between the input current ILOAD corresponding to the vibration signal VS with different frequencies (i.e. the calibration frequencies FCAL_1-FCAL_n) as shown in FIG. 3A or a relationship between the input power levels corresponding to the vibration signal VS with different frequencies (i.e. the calibration frequencies FCAL_1-FCAL_n) as shown in FIG. 3B.

Figure 3A:
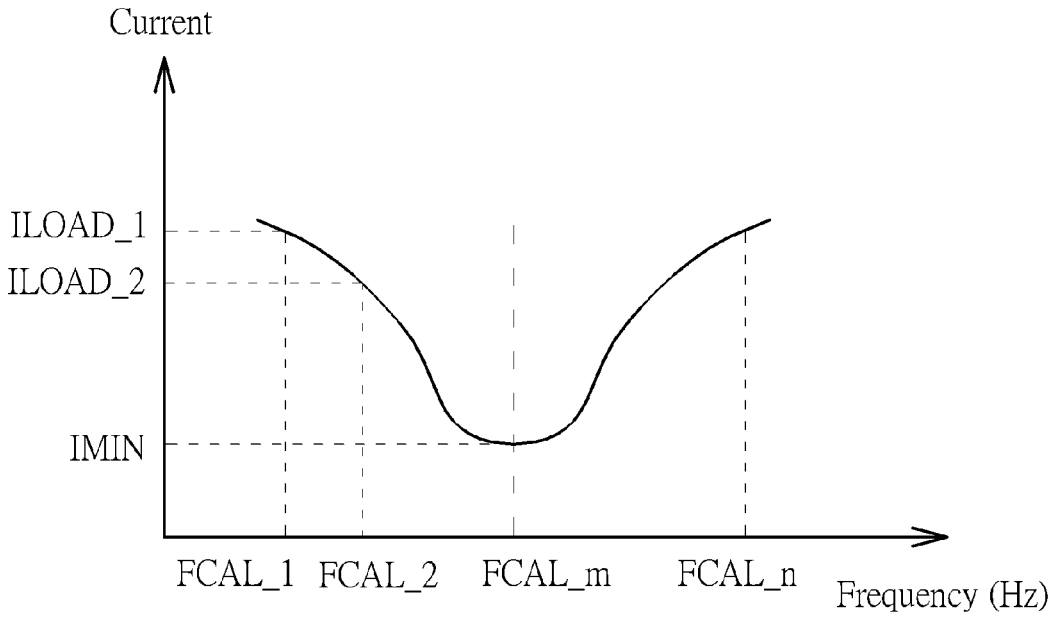
Figure 3B:
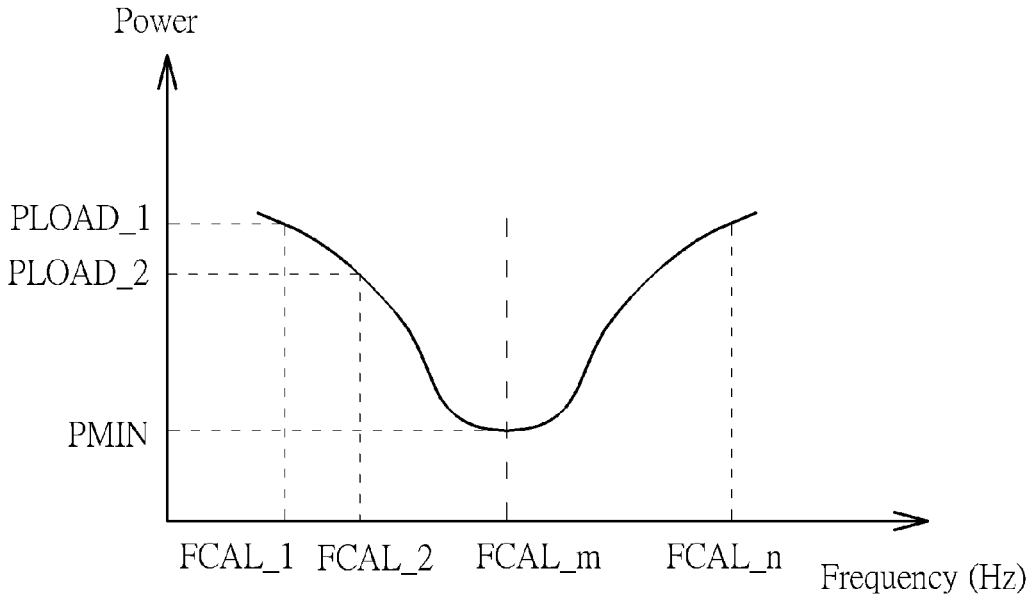

Note that, the frequency monotonically increases from the calibration frequency FCAL_1 to the calibration frequency FCAL_n in FIG. 3A, but is not limited herein. As long as the input current ILOAD corresponding to a frequency range between the calibration frequency FCAL_1 and the calibration frequency FCAL_n is acquired, the acquiring sequences of the input current ILOAD_1-ILOAD_n may be changed.

Figure 4:
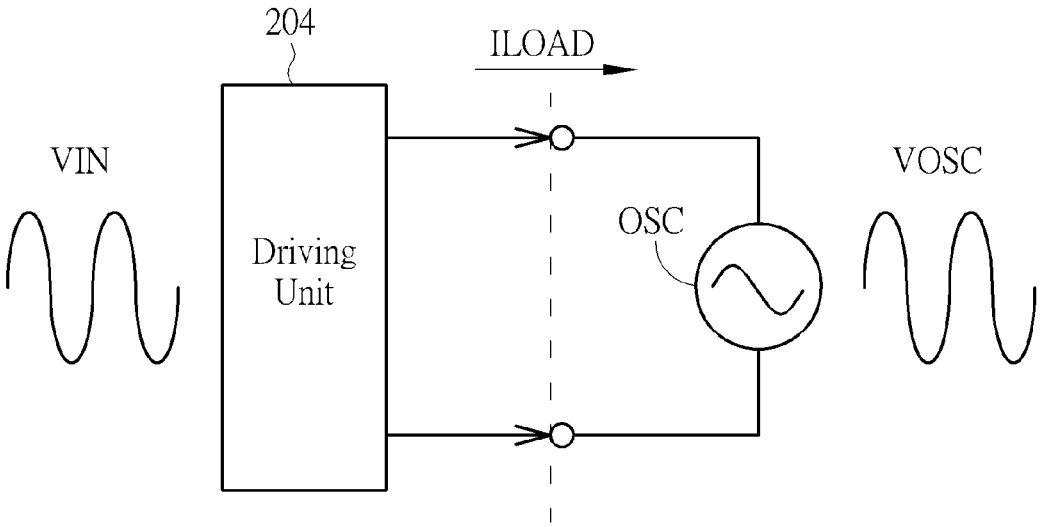

Next, the computing unit 210 determines the vibration point VP of the vibration unit 206 (i.e. the vibration point VP of the vibration module 200 or the vibration point VP of the vibration device 20) according to the input currents ILOAD_1-ILOAD_n or the input power levels PLOAD_1-PLOAD_n. Following takes the input currents detection as an example for illustration. Please refer to FIG. 4, which is a simplified circuit diagram of the vibration module 200 shown in FIG. 2. In FIG. 4, the vibration unit 206 is simulated and represented by an oscillator OSC which generates an output signal VOSC according to the vibration signal VS generated by the driving unit 204, and a frequency of the output signal VOSC is the vibration point VP of the vibration unit 206. As can be seen from FIG. 4, the input current ILOAD transmitted from the driving unit 204 to the oscillator OSC is determined according to a voltage difference between an input signal VIN (corresponding to the vibration signal VS) and the output signal VOSC. More specifically, the input current ILOAD is proportional to the voltage difference between the input signal VIN and the output signal VOSC. The input current ILOAD approximates to zero if the input signal VIN equals the output signal VOSC. That is, the input current ILOAD becomes smaller when the frequency of the input signal VIN becomes closer to the vibration point VP of the vibration unit 206. Therefore, the computing unit 210 searches a minimum value IMIN among the input currents ILOAD_1-ILOAD_n and determines a calibration frequency FCAL_m corresponding to the minimum value IMIN as the vibration point VP as shown in FIG. 3.

Figure 5A:
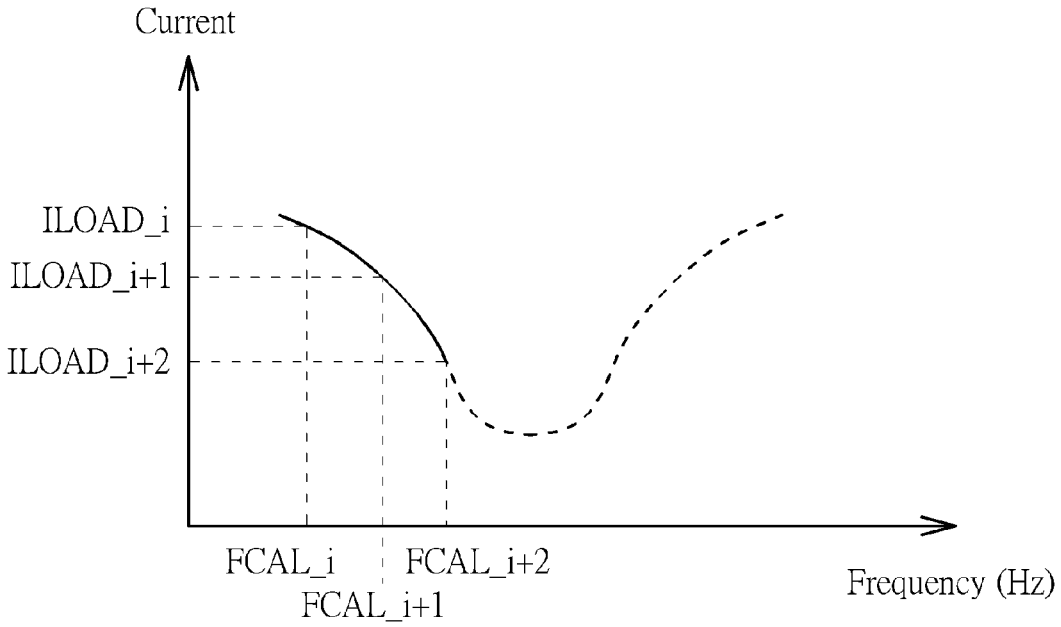

According to the different design requirements, the method of acquiring the minimum value IMIN and the calibration frequency FCAL_m may be appropriately altered. In an embodiment, the computing unit 210 searches the minimum value IMIN and the corresponding calibration frequency FCAL_m after acquiring all the input currents ILOAD_1-ILOAD_n. In another embodiment, the computing unit 210 may determine the minimum value IMIN while sequentially acquiring the input currents ILOAD_1-ILOAD_n. For example, please refer to FIG. 5A, when the computing unit 210 acquires an input current ILOAD_i+1 corresponding to a calibration frequency FCAL_i+1 while sequentially acquiring the input currents ILOAD_1-ILOAD_n, the computing unit 210 compares the input current ILOAD_i+1 and an input current ILOAD_i corresponding to a calibration frequency FCAL_i for determining whether the calibration frequency FCAL_i is the vibration point VP. As shown in FIG. 5A, the calibration frequency FCAL_i and the calibration frequency FCAL_i+1 are contiguous calibration frequencies among the calibration frequencies FCAL_1-FCAL_n and the calibration frequency FCAL_i is smaller than the calibration frequency FCAL_i+1. Since the input current ILOAD is monotonically decreased before the vibration point VP and is monotonically increased after the vibration point VP, ideally, the input current ILOAD_i should be smaller than the input current ILOAD_i+1 if the calibration frequency FCAL_i is the vibration point VP. Thus, the computing unit 210 determines that the calibration frequency FCAL_i is the vibration point VP when the input current ILOAD_i is smaller than the input current ILOAD_i+1; otherwise, the computing unit 210 determines that the calibration frequency FCAL_i is not the vibration point VP and continues to acquire an input current ILOAD_i+2. Via repeating the above procedures, the computing unit 210 may acquire the vibration point VP while sequentially detecting the input current ILOAD_1-ILOAD_n. In other words, the computing unit 210 does not need to detect and store all the input currents ILOAD_1-ILOAD_n. The manufacture cost of the vibration device 20 may be decreased since the computing unit 210 may be realized without a memory device for storing the input currents ILOAD_1-ILOAD_n.

Figure 5B:
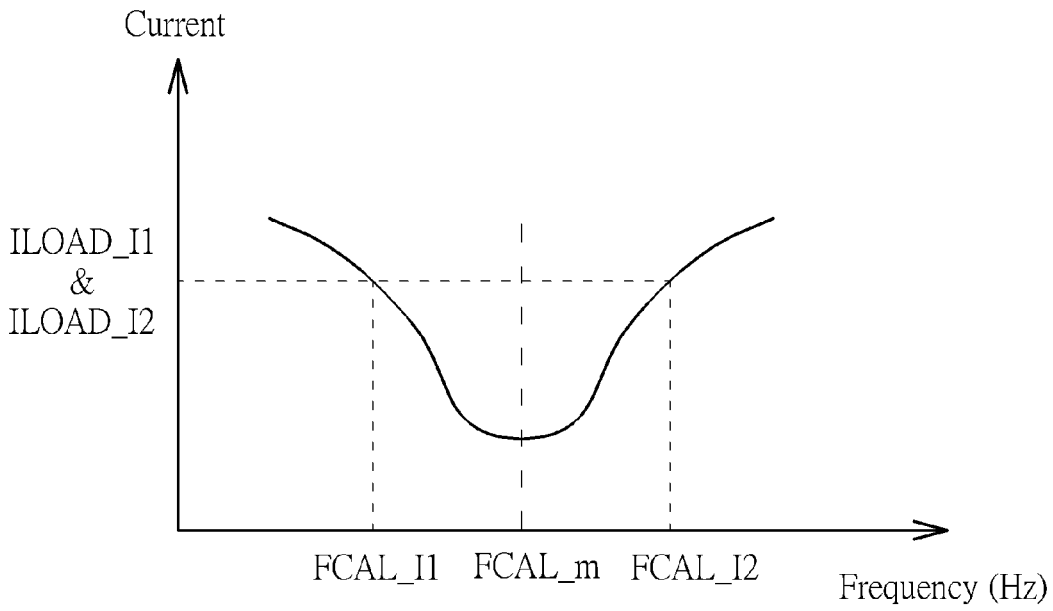

In still another embodiment, the computing unit 210 may acquire the vibration point VP via interpolating the calibration frequencies FCAL_1-FCAL_n according to the input currents ILOAD_1-ILOAD_n. Please refer to FIG. 5B, which is a schematic diagram of the relationship between the input current ILOAD and the calibration frequencies FCAL_1-FCAL_n. Since the curve build according to the relationship between the input currents ILOAD_1-ILOAD_n and the calibration frequencies FCAL_1-FCAL_n is substantially symmetric, ideally, the vibration point VP may be acquired via interpolating calibration frequencies with substantially the same current value. As shown in FIG. 5, an input current ILOAD_I1 corresponding to a calibration frequency FCAL_I1 and an input current ILOAD_I2 corresponding to a calibration frequency FCAL_I2 have substantially the same current value. The calibration frequency FCAL_m corresponding to the vibration point VP locates at a midpoint of the calibration frequencies FCAL_I1, FCAL_I2 due to the symmetry of the curve. The computing unit 210 therefore may acquire the calibration frequency FCAL_m via averaging the calibration frequencies FCAL_I1, FCAL_12.

Please note that, the computing unit 210 may acquire the calibration frequencies FCAL_I1, FCAL_I2 for interpolating the vibration point VP after acquiring all the input currents ILOAD_1-ILOAD_n. Or, the computing unit 210 may first acquire the calibration frequencies FCAL_I1 and the corresponding input current ILOAD_I1; then, the computing unit 210 finds a calibration frequency corresponding to the same current value of the input current ILOAD_I1 as the calibration frequency FCAL_I2. That is, the computing unit 210 does not need to acquire all the input currents ILOAD_1-ILOAD_n for determining the vibration point VP of the vibration unit 206 and the time of determining the vibration point VP of the vibration unit 206 may be reduced, therefore. In yet another embodiment, the computing unit 210 may perform several times of above interpolation process by choosing different target input current values, and obtain a final calibration frequency as the vibration point VP by averaging the several calibration frequencies FCAL_m. This helps reduce the impact of non-ideality.

Figure 6A:
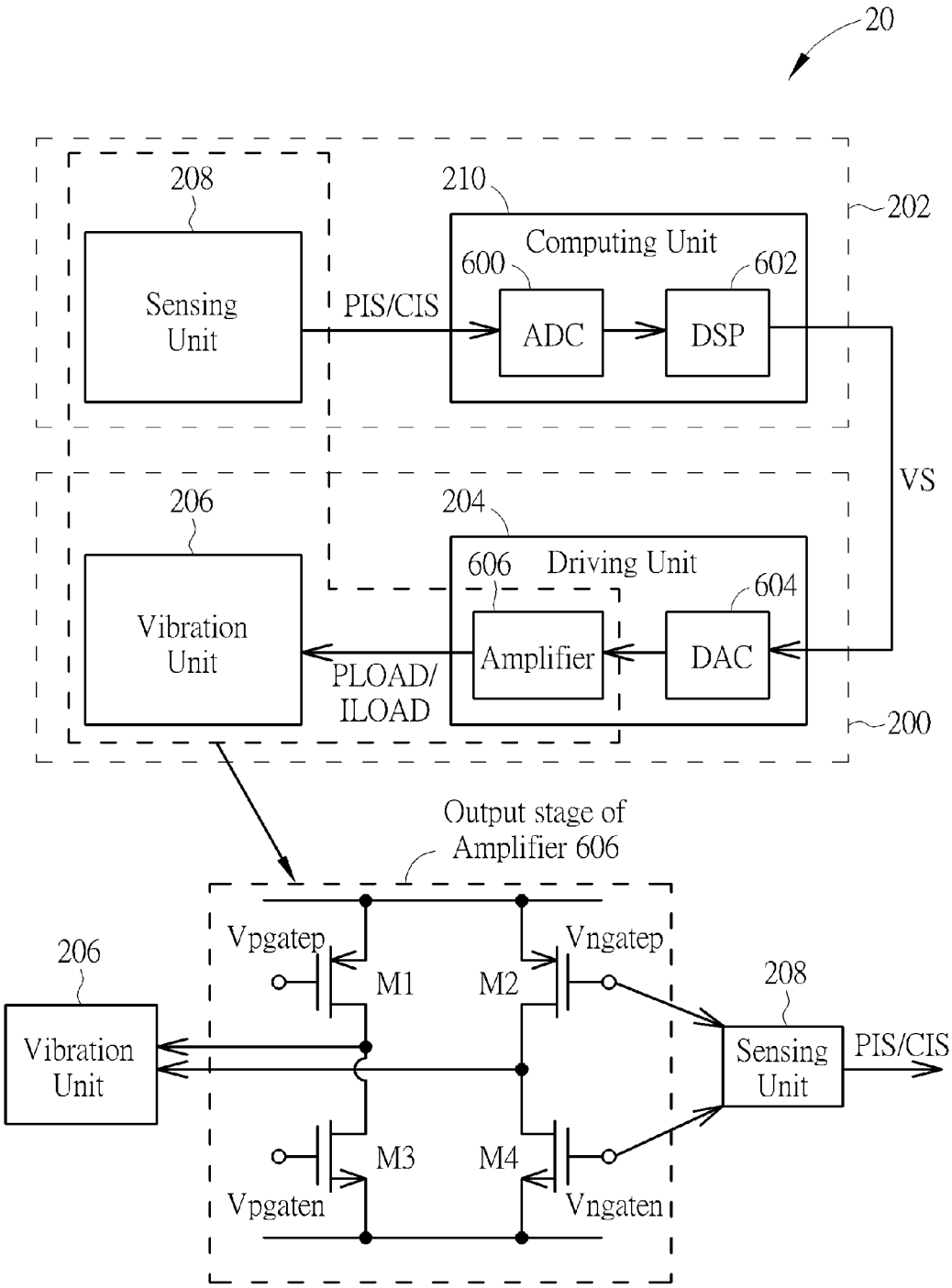

The above embodiments determine the vibration point of the vibration unit (e.g. vibration speaker or vibration driver) via detecting the input currents of the vibration unit corresponding to the vibration signal with the different frequencies. Please note that a similar performance can be obtained by detecting input power levels. As a person with ordinary knowledge in the art shall understand the modifications from current sensing to power sensing after reading above description, details are omitted here for brevity. According to different applications, those with ordinary knowledge in the art may observe appropriate alternations or modifications. For example, please refer to FIG. 6A, which is a schematic diagram of a realization of the vibration device 20 shown in FIG. 2. In FIG. 6A, the computing unit 210 comprises an analog-to-digital convertor (ADC) 600 and a digital signal processor (DSP) 602 and the driving unit 204 comprises a digital-to-analog convertor (DAC) 604 and an amplifier 606. The ADC 600 is utilized for transforming the current indicating signal CIS or the power indicating signal PIS to a digital signal capable of being processed by the DSP 602. The DAC 604 is utilized for converting the vibration signal VS to an analog signal for allowing the amplifier 606 to generate the input current ILOAD. The sensing unit 208 is coupled to voltages Vngatep, Vngaten of an output stage in the amplifier 606 as shown in FIG. 6A. The sensing unit 208 therefore may determine the input current ILOAD according to the voltages Vngatep, Vngaten. As a result, the vibration device 20 shown in FIG. 6A is capable of determining the vibration point VP according to the input current ILOAD corresponding to the vibration signal VS with different frequencies.

Figure 6B:
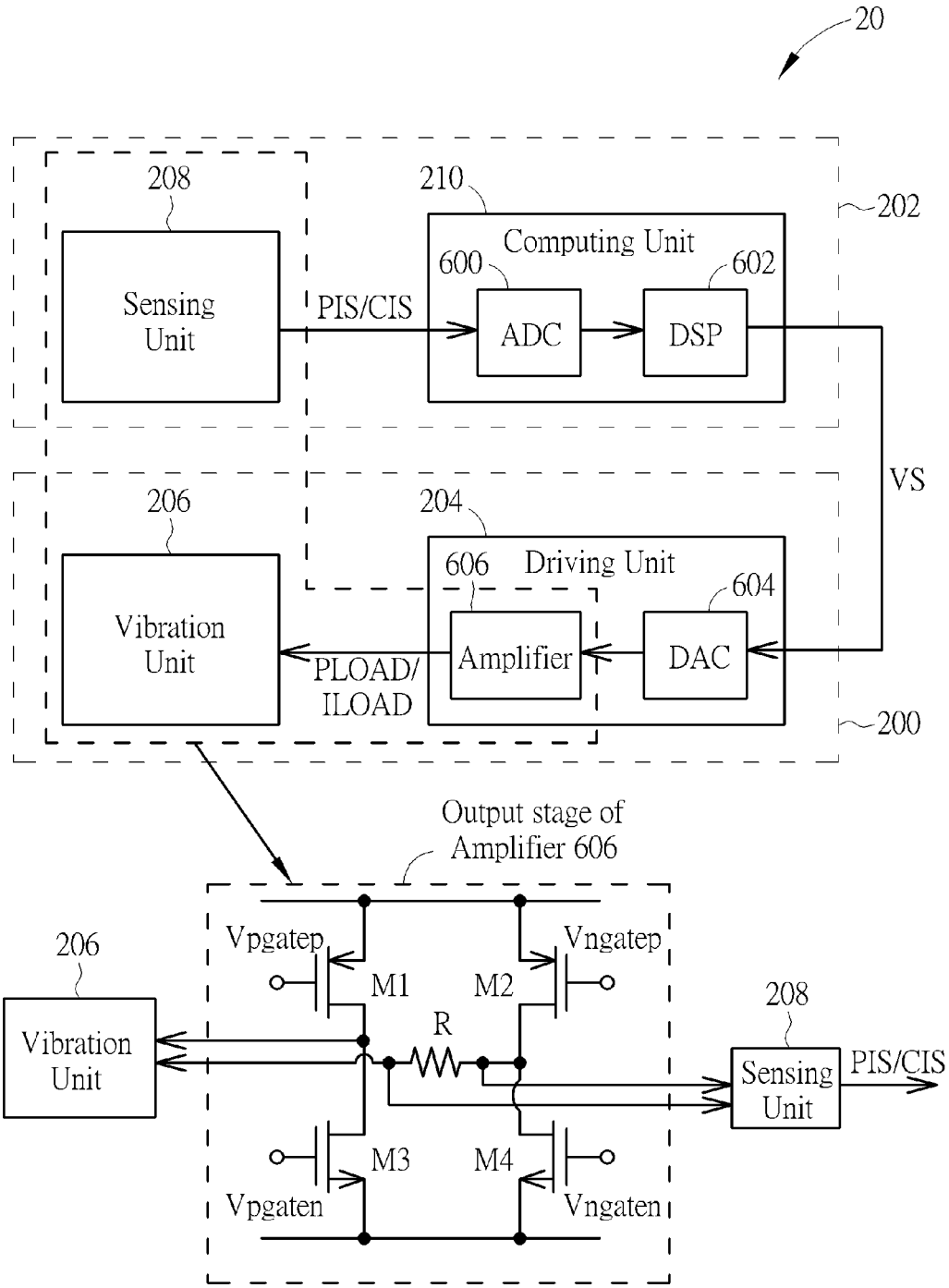

Please refer to FIG. 6B, which is a schematic diagram of another realization of the vibration device 20 shown in FIG. 2. The structure of the vibration device 20 shown in FIG. 6B is similar to that of the vibration device 20 shown in FIG. 6A, the components and the signals with similar functions are denoted by the same symbols, therefore. Different from the vibration device 20 shown in FIG. 6A, the sensing unit 208 is coupled to a resistor R in the output stage of the amplifier 606. The voltage across the resistance R is proportional to the input current ILOAD. The sensing unit 208 therefore may determine the input current ILOAD according to the voltage across the resistor R.

Figure 6C:
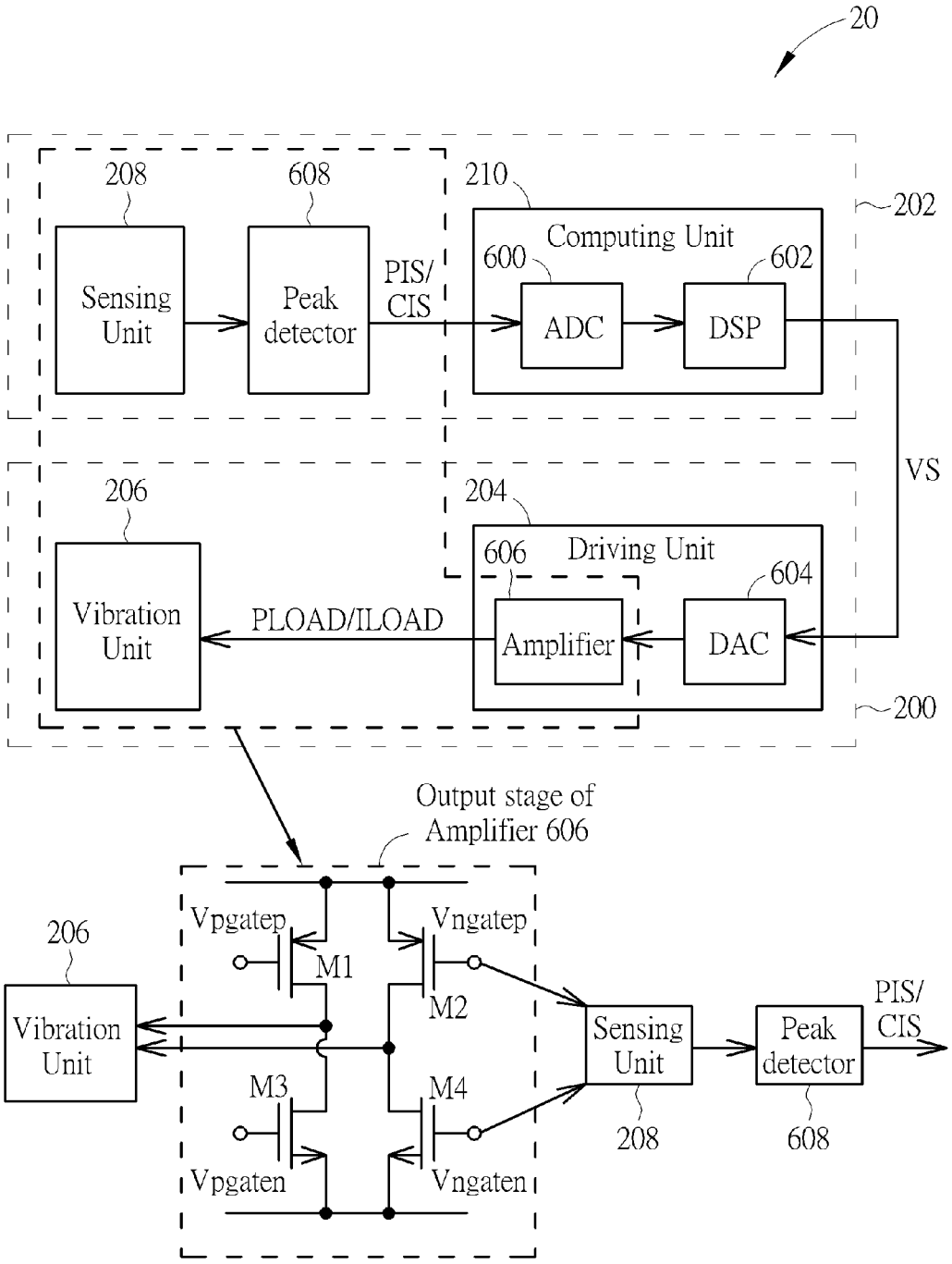

On the other hand, please refer to FIG. 6C which is a schematic diagram of still another realization of the vibration device 20 shown in FIG. 2. The structure of the vibration device 20 shown in FIG. 6C is similar to that of the vibration device 20 shown in FIG. 6A, the components and the signals with similar functions are denoted by the same symbols, therefore. In FIG. 6C, a peak detector 608 is added between the sensing unit 208 and the computing unit 210. The Peak detector 610 is utilized for detecting the maximum current value of the input current ILOAD within a period. Via adding peak detector 608, the design of the ADC 600 may be simplified and the manufacture cost of the vibration device 20 may be reduced, therefore.

Figure 6D:
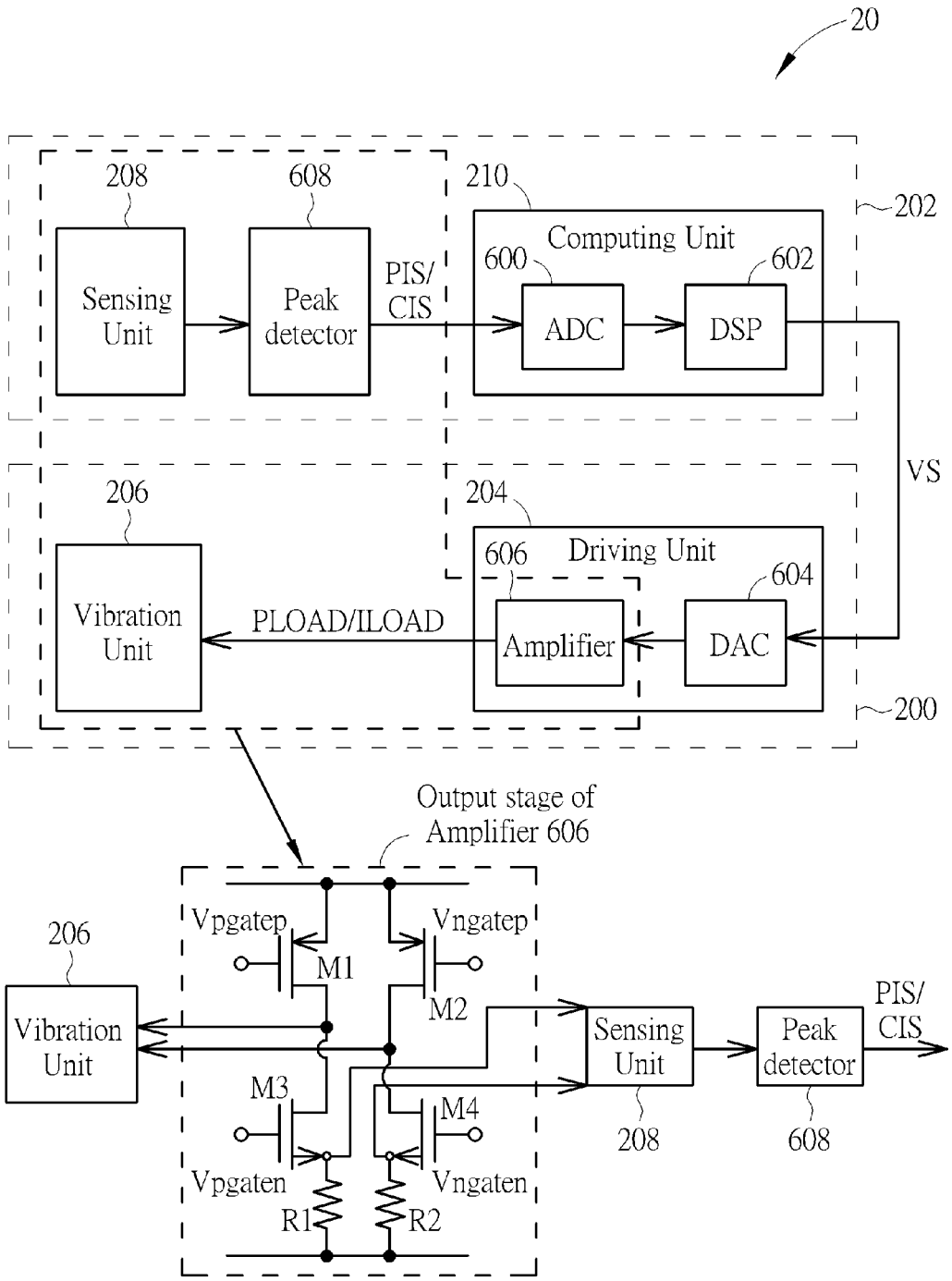

Furthermore, please refer to FIG. 6D, which is a schematic diagram of another realization of the vibration device 20 shown in FIG. 2. The structure of the vibration device 20 shown in FIG. 6C is similar to that of the vibration device 20 shown in FIG. 6A, the components and the signals with similar functions are denoted by the same symbols, therefore. In comparison to the above embodiments, the sensing unit 208 changes to sense the currents passing through the transistors of the output stage of the amplifier 606 for generating the current instruction signal CIS (note that the peak detector 608 may be omitted). As shown in FIG. 6D, the sensing unit 208 is coupled to the nodes between the transistor M3 and a resistor R1 and between the transistor M4 and a resistor R2, for sensing the currents of the transistors M3 and M4 and generating the current instruction signal CIS accordingly. In such a condition, the common mode rejection ratio (CMRR) of the sensing unit 208 can be further relaxed.

Figure 7:
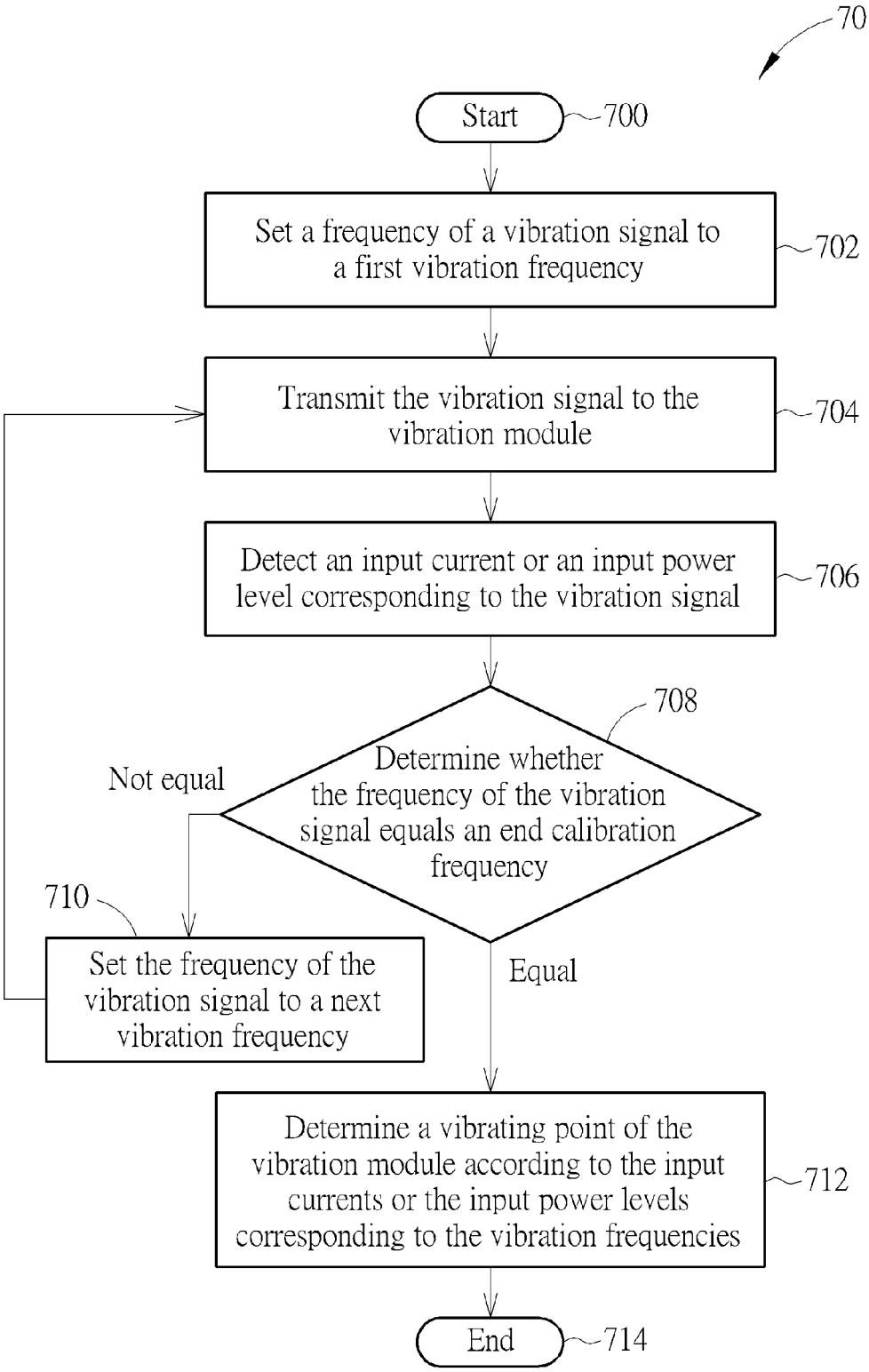

The above-mentioned process of determining a vibration point of a vibration module according to input current corresponding to different frequencies may be summarized to a calibration method 70, as shown in FIG. 7. The calibration method 70 comprises the following steps:

Step 700: Start.

Step 702: Set a frequency of a vibration signal to a first calibration frequency.

Step 704: Transmit the vibration signal to the vibration module.

Step 706: Detect an input current or an input power level corresponding to the vibration signal.

Step 708: Determine whether the frequency of the vibration signal equals an end calibration frequency FCALEND, and perform step 710 if the frequency of the vibration signal does not equal an end calibration frequency; otherwise, perform step 712.

Step 710: Set the frequency of the vibration signal to a next calibration frequency.

Step 712: Determine a vibrating point of the vibration module according to the input currents or the input power levels corresponding to the vibration frequencies.

Step 714: End.

According to the calibration method 70, the criterion of the end calibration frequency in Step 708 may vary depending on the calibration schemes (e.g. FIGS. 5A-5B). For example, the end calibration frequency may be FCAL_n, FCAL_m whose corresponding input current/power is larger than that of FCAL_m−1, or FCAL_m whose corresponding input current/power is substantially equal to the target ILOAD/PLOAD value secondly. Therefore, the input currents or the input power levels corresponding to the different calibration frequencies may be sequentially acquired and the vibration point of the vibration module may be precisely detected according to the input currents or the input power levels corresponding to the different calibration frequencies. Or, the vibration point may be determined while detecting the input currents or the input power levels corresponding to the different calibration frequencies. It is not necessary to acquire all the input currents. Furthermore, the vibration point may also be determined according to specific calibration frequencies (e.g. the calibration frequencies corresponding to the input currents with the same current value). The details of the calibration method 70 may be known by referring to the above, and are not narrated herein for brevity.

To sum up, the calibration method and the calibration module of the above embodiments determines the vibration point of the vibration module according to the input currents or the input power levels of the vibration module corresponding to different calibration frequencies. The frequency of the vibration signal inputted to the vibration module may be appropriately modified. As a result, the vibration function of the vibration module may be prevented from being disabled or degradation due to variations of the vibration point.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A calibration method for a vibration speaker, comprising:

transmitting a plurality of vibration signals corresponding to a plurality of calibration frequencies to the vibration speaker and detecting a plurality of input currents or input power levels generated by an output stage of the vibration speaker corresponding to the plurality of calibration frequencies; and determining a vibration point of a vibration unit of the vibration speaker according to the plurality of input currents or input power levels;

wherein the output stage is utilized for driving the vibration unit according to the plurality of vibration signals and comprises:

a first transistor, comprising a gate coupled to a first control voltage, a source coupled to a first voltage source, and a drain coupled to a first node that is coupled to the vibration unit;

a second transistor, comprising a gate coupled to a second control voltage, a source coupled to the first voltage source, and a drain coupled to a second node that is coupled to the vibration unit;

a third transistor, comprising a gate coupled to a third control voltage, a source coupled to a second voltage source, and a drain coupled to the first node; and a fourth transistor, comprising a gate coupled to a fourth control voltage, a source coupled to the second voltage source, and a drain coupled to the second node.

2. The calibration method of claim 1, wherein the step of transmitting the plurality of vibration signals corresponding to the plurality of calibration frequencies to the vibration speaker and detecting the plurality of input currents or input power levels generated by the output stage of the vibration speaker corresponding to the plurality of calibration frequencies comprises:

setting the frequency of a first vibration signal to a first calibration frequency of the plurality of calibration frequencies;

transmitting the first vibration signal to the vibration speaker;

detecting a first input current or a first input power level generated by the output stage corresponding to the first calibration frequency;

determining whether the first calibration frequency equals an end calibration frequency.

3. The calibration method of claim 2, wherein the step of determining whether the first calibration frequency equals an end calibration frequency comprises:

setting the frequency of a second vibration signal to a second calibration frequency of the plurality of calibration frequencies when the first calibration frequency does not equal the end calibration frequency;

transmitting the second vibration signal to the vibration speaker;

detecting a second input current or a second input power level corresponding to the second calibration frequency;

determining whether the second calibration frequency equals the end calibration frequency.

4. The calibration method of claim 1, wherein the step of determining the vibration point of the vibration speaker according to the plurality of input currents or input power levels comprises:

acquiring a first calibration frequency as the vibration point when a first input current or a first input power level corresponding to the first calibration frequency corresponds to the minimum current or minimum power level among the plurality of input currents or input power levels.

5. The calibration method of claim 1, wherein the step of determining the vibration point of the vibration speaker according to the plurality of input currents or input power levels comprises:

acquiring a first calibration frequency as the vibration point if a first input current or a first input power level is smaller than a second input current or a second input power level corresponding to a second calibration frequency, the first calibration frequency and the second calibration frequency are contiguous and the first calibration frequency is smaller than the second calibration frequency while sequentially acquiring the plurality of input currents or input power levels.

6. The calibration method of claim 1, wherein the step of determining the vibration point of the vibration speaker according to the plurality of input currents comprises:

determining the vibration point of the vibration speaker via interpolating the plurality of calibration frequencies according to the plurality of input currents or input power levels.

7. The calibration method of claim 6, wherein the step of determining the vibration point of the vibration speaker via interpolating the plurality of calibration frequencies according to the plurality of input currents or input power levels comprises:

acquiring an average of a first calibration frequency and a second calibration frequency as the vibration point, wherein a first input current or a first input power level corresponding to the first calibration frequency and a second input current or a second input power level corresponding to the second calibration frequency are the same.

8. The calibration method of claim 1, wherein the vibration point of the vibration speaker is in a frequency band of 100 Hz-200 Hz.

9. A calibration module for a vibration speaker, comprising:

a computing unit coupled to the vibration speaker, for transmitting a plurality of vibration signals corresponding to a plurality of calibration frequencies to the vibration speaker and determining a vibration point of a vibration unit of the vibration speaker according to a plurality of input currents or input power levels; and a sensing unit coupled to an output stage of the vibration speaker, for detecting the plurality of input currents or input power levels generated by the output stage of the vibration speaker corresponding to the plurality of calibration frequencies;

wherein the output stage is utilized for driving the vibration unit according to the plurality of vibration signals and comprises:

a first transistor, comprising a gate coupled to a first control voltage, a source coupled to a first voltage source, and a drain coupled to a first node that is coupled to the vibration unit;

a second transistor, comprising a gate coupled to a second control voltage, a source coupled to the first voltage source, and a drain coupled to a second node that is coupled to the vibration unit;

a third transistor, comprising a gate coupled to a third control voltage, a source coupled to a second voltage source, and a drain coupled to the first node; and a fourth transistor, comprising a gate coupled to a fourth control voltage, a source coupled to the second voltage source, and a drain coupled to the second node.

10. The calibration module of claim 9, wherein the computing unit sets the frequency of a first vibration signal to a first calibration frequency of the plurality of calibration frequencies and transmits the first vibration signal to the vibration speaker; the sensing unit detects a first input current or a first input power level generated by the output stage corresponding to the first calibration frequency; and the computing unit determines whether the first calibration frequency equals an end calibration frequency.

11. The calibration module of claim 10, wherein the computing unit sets the frequency of a second vibration signal to a second calibration frequency of the plurality of calibration frequencies and transmits the second vibration signal to the vibration speaker when the first calibration frequency does not equal the end calibration frequency; the sensing unit detects a second input current or a second input power level corresponding to the second calibration frequency; and the computing unit determines whether the second calibration frequency equals the end calibration frequency.

12. The calibration module of claim 9, wherein the computing unit acquires a first calibration frequency as the vibration point when a first input current or a first input power level corresponding to the first calibration frequency is the minimum current or the minimum power level among the plurality of input currents or input power levels.

13. The calibration module of claim 9, wherein the computing unit acquires a first calibration frequency as the vibration point if a first input current or a first input power level is smaller than a second input current or a second input power level corresponding to a second calibration frequency, the first calibration frequency and the second calibration frequency are contiguous and the first calibration frequency is smaller than the second calibration frequency while sequentially acquiring the plurality of input currents or input power levels.

14. The calibration module of claim 9, wherein the computing unit determines the vibration point of the vibration speaker via interpolating the plurality of calibration frequencies according to the plurality of input currents or input power levels.

15. The calibration module of claim 14, wherein the computing unit acquires an average of a first calibration frequency and a second calibration frequency as the vibration point, wherein a first input current or a first input power level corresponding to the first calibration frequency and a second input current or a second input power level corresponding to the second calibration frequency are the same.

16. The calibration module of claim 9, wherein the sensing unit detects the plurality of input currents or input power levels according to the second control voltage and the fourth control voltage.

17. The calibration module of claim 9, wherein the output stage further comprises a resistor coupled between the vibration unit and the second node and the sensing unit detects the plurality of input currents or input power levels according to the voltage across the resistor.

18. The calibration module of claim 9, wherein the sensing unit detects peak input currents or peak input power levels generated by the output stage in response to the plurality of calibration frequencies as the plurality of input currents or input power levels.

19. The calibration module of claim 9, wherein the vibration point of the vibration speaker is in a frequency band of 100 Hz-200 Hz.

* * * * *